US009873499B2

(12) United States Patent
Austin et al.

(10) Patent No.: US 9,873,499 B2
(45) Date of Patent: Jan. 23, 2018

(54) ASYMMETRIC PROPULSION AND MANEUVERING SYSTEM

(71) Applicant: Woods Hole Oceanographic Institution, Woods Hole, MA (US)

(72) Inventors: Thomas Austin, Falmouth, MA (US); Michael Purcell, North Falmouth, MA (US); Frederic Jaffre, East Falmouth, MA (US); Jeffrey Kaeli, Woods Hole, MA (US); Ben Allen, Cataumet, MA (US); Robin Littlefield, Falmouth, MA (US)

(73) Assignee: Woods Hole Oceanographic Institution, Woods Hole, MA (US)

( * ) Notice: Subject to any disclaimer, the term of this patent is extended or adjusted under 35 U.S.C. 154(b) by 0 days.

(21) Appl. No.: 14/762,852

(22) PCT Filed: Apr. 2, 2015

(86) PCT No.: PCT/US2015/023970
§ 371 (c)(1),
(2) Date: Jul. 23, 2015

(87) PCT Pub. No.: WO2015/153825
PCT Pub. Date: Oct. 8, 2015

(65) Prior Publication Data

US 2017/0015398 A1 Jan. 19, 2017

(51) Int. Cl.

| | |
|---|---|
| ***B63H 25/42*** | (2006.01) |
| ***B63H 1/14*** | (2006.01) |
| ***B63H 1/26*** | (2006.01) |

(52) U.S. Cl.
CPC ..... *B63H 25/42* (2013.01); *B63H 1/14* (2013.01); *B63H 1/26* (2013.01); *B63B 2747/00* (2013.01)

(58) Field of Classification Search
CPC . B63H 1/26; B63H 3/002; B63H 1/14; B63H 1/08
See application file for complete search history.

(56) References Cited

U.S. PATENT DOCUMENTS

| | | | | |
|---|---|---|---|---|
| 137,472 | A | 3/1944 | Birsh | |
| 2,371,160 | A | 3/1945 | Everts | |
| 3,312,286 | A * | 4/1967 | Irgens | B63H 1/14 416/19 |
| 5,083,948 | A | 1/1992 | Grobson | |
| 5,971,322 | A | 10/1999 | Beretta et al. | |
| 6,155,894 | A | 12/2000 | Allison | |

(Continued)

FOREIGN PATENT DOCUMENTS

WO WO-2010-107316 A1 9/2010

*Primary Examiner* — Edwin Swinehart
(74) *Attorney, Agent, or Firm* — Robert Devin Ricci; Russel O. Primeaux; Kean Miller LLP

(57) ABSTRACT

An asymmetric propulsion mechanism capable of providing both axial thrust as well as lateral maneuverability from a single axis of rotation is described. The mechanism may be used on aquatic vehicles to minimize cost and maximize reliability and endurance. The mechanism comprises one or more propeller blades disposed asymmetrically around a rotating hub under the guidance of a control system including a motor capable of driving the propeller at various radial speeds throughout the course of a single revolution.

26 Claims, 3 Drawing Sheets

(56) References Cited

U.S. PATENT DOCUMENTS

| | | | | |
|---|---|---|---|---|
| 6,244,919 | B1 * | 6/2001 | Valentini | B63H 1/10 416/108 |
| 6,287,078 | B1 | 9/2001 | Min et al. | |
| 6,358,008 | B1 | 3/2002 | Chen | |
| 7,841,831 | B2 | 11/2010 | Chen | |
| 8,511,177 | B1 | 8/2013 | Makaremi | |
| 8,608,441 | B2 * | 12/2013 | Hotto | F03D 1/0608 416/42 |
| 2011/0028057 | A1 | 2/2011 | Torrangs et al. | |
| 2012/0288373 | A1 | 11/2012 | Duong et al. | |
| 2016/0083077 | A1 | 3/2016 | Rawdon | |

* cited by examiner

ASYMMETRIC PROPULSION AND MANEUVERING SYSTEM

CROSS REFERENCE TO RELATED APPLICATIONS

This application is the National Stage of International Application No. PCT/US15/023970, filed Apr. 2, 2015, which claims the benefit of U.S. patent application Ser. No. 61/975,253, filed Apr. 4, 2015, which is hereby incorporated by reference in its entirety.

DISCUSSION

Figure 1:
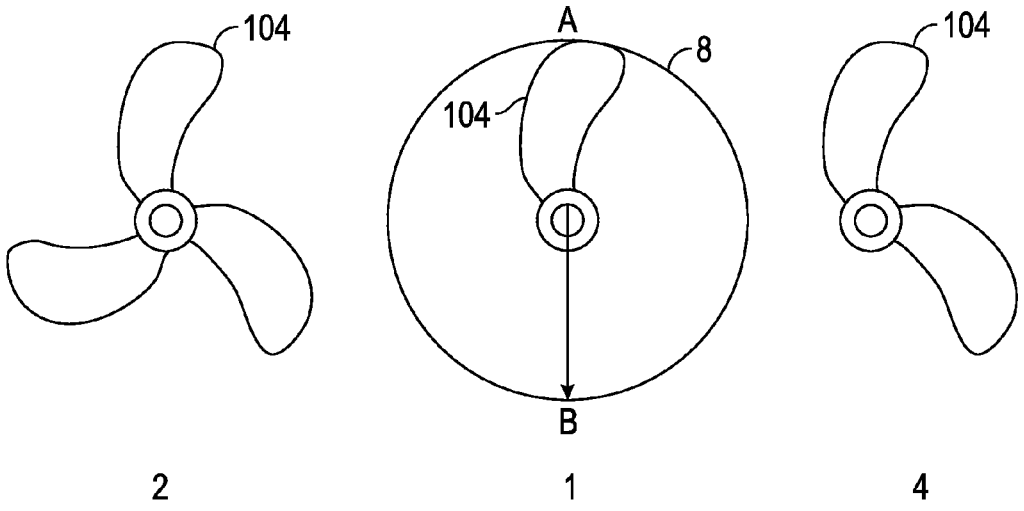
FIG. 1 is a cross sectional view of multiple propeller configurations.

The invention is generally directed to a propulsion system for an aquatic vehicle. In one or more embodiments, the system comprises a marine thruster (i.e., propeller) further comprising an asymmetric distribution of one or more propeller blades, i.e., thrusting surfaces, disposed around a central hub or shaft of a motor with an integrated control mechanism optionally capable of sensing the radial position of at least one of the blades. The system is further capable of executing various radial blade speeds throughout the course of a single revolution as a means to maneuver the vehicle.

A marine thruster is generally a transversal propulsion device, powered to convert rotational movement into thrust force, built into, or mounted on, a nautical craft or aquatic vehicle such as a ship, boat, or underwater vehicle, an autonomous underwater vehicle (AUV), an unmanned underwater vehicle (UUV), a glider, a human occupied vehicle (HOV), remotely operated vehicle (ROV), a glider, a submarine, a mini submarine, a marine vessel, or similar vehicles. Thrusters generally comprise a housing attached to the outer surface of the vehicle to be propelled and an electric motor enclosed within and connected to a propeller which is in contact with the water. Propellers are generally designed with two or more blades disposed symmetrically and/or evenly spaced around a central hub.

Underwater vehicles and submersibles may employ one or more thrusters for propulsion and one or more actuators for maneuverability. In many circumstances, two or more thrusters may be used in combination as the principal form of maneuverability as well as propulsion. Rotational speed is generally variable in marine thruster motors, and may be set to specific constant values to provide propulsion or maneuverability.

For balance and efficiency, most guidance on propeller design requires that propeller blades be disposed symmetrically around the propeller hub to evenly distribute stress forces and powered in a constant fashion as they revolve. Traditionally, there has been no need to systematically and repeatedly vary propeller rotational speed within a single revolution, nor has the use of asymmetrically disposed propeller blades been advocated. While asymmetrically disposed propeller blades have found limited applications in the aerial realm, their use has been restricted to lightweight glider aircraft where, after a traditional powered takeoff, a single-bladed propeller can be easily stowed for unpowered flight and is not used for maneuvering in the manner described here. Single bladed propellers have been tested on long-endurance underwater vehicles for efficient forward propulsion, but not for maneuverability.

The asymmetric propulsion system invention described herein advances marine propulsion over traditional symmetric thruster designs by reducing, in one or more embodiments: (1) the complexity of propulsion and maneuverability from several degrees of freedom to a single axis of rotation; (2) the number of failure modes by minimizing the number of required of actuators and the number of through holes in the hull; (3) the cost to manufacture due to design simplicity; (4) the wake interference through the use of a minimum number of propeller blades; and (5) biofouling due to use of a minimum number of propeller blades.

DETAILED DESCRIPTION

The subject matter of the present invention is described with specificity herein to meet statutory requirements. However, the description itself is not intended to necessarily limit the scope of claims. Rather, the claimed subject matter might be embodied in other ways to include different components or combinations of components similar to the ones described in this document in either form or function, in conjunction with other present or future technologies.

Various embodiments of the asymmetric propulsion systems as described herein are distinguished from traditional propulsion systems utilizing propellers with symmetrically disposed blades for forward propulsion and actuators for lateral maneuverability. Indeed, one or more embodiments of the subject invention allow for both propulsion and maneuverability from a single propeller by either disposing the propeller blades or thrusting forces asymmetrically around a hub, or both, and varying the rotational velocity of the propeller within individual revolutions. In many of the embodiments herein, the inventive system is often referred to in the marine setting (i.e., salt water, fresh water, or any suitable water) but may be adapted as a propulsion system for land or aerial use.

In ordinary use of the inventive propulsion systems, forward propulsion may be achieved by driving the propeller at a constant rotational velocity. Change of direction can likewise be accomplished by systematic alteration of the instantaneous rotational velocity as a function of angular position of the blade to cause the propeller to travel faster during one segment of an individual revolution than during the other segments of the revolution. Since lift is proportional to the square of the velocity, the forces are greater on the side of the axis with the most thrusting surface, inducing a turning moment.

Asymmetric Propeller Systems

For the purposes of this description, a propeller is considered an asymmetric propeller if there is more thrusting force generated from the propeller blade surface on one side of the axis of rotation relative to the other. In general, the inventive propellers have a central hub around which one or more blades are disposed radially outward. The hub is induced to rotate around its center (establishing a central axis of rotation) due to its connection to a rotating motor, either directly or by a connecting system such as a drive shaft, crank shaft, gear box, cable, or other connecting means. The blades of the propeller are positioned to rotate with the hub to provide the motive or thrusting force.

FIG. 1 presents multiple configurations of propeller blades to illustrate asymmetry. In the Figure, propeller 2 represents a traditional symmetric 3-bladed propeller; propeller 1 represents one possible realization of an asymmetric propeller with a single blade 104; and propeller 4 one possible realization of an asymmetric propeller with multiple blades 104. Moreover, as will be discussed further herein, the arc of the blade revolution is shown by the dashed line 8. A desired turning direction is indicated by the arrow and the letter B. The point directly opposite B is indicated as A. In order to effect a turn in the direction B, the net increase in velocity for a single revolution must be centered around A.

The blades may be of any suitable shape or design meant to generate thrust as the propeller rotates about its central hub 112 in the water. One key feature of the invention is that the at least one blade 104 is situated around the rotating central hub 112 such that thrust is not equally generated on opposing halves of the propeller or propeller hub 112 as is shown in FIG. 1. Another way to generate differential thrust for maneuverability is to actuate the at least one blade as a function of angular position. For instance, by way of illustrative comparison, a helicopter propulsion system changes the blade pitch as a function of position to generate differential lift and achieve forward motion. The inventive system, however, is distinct from such an apparatus in that in most embodiments, the asymmetry is static and relies solely on the speed control of at least one actuator.

Figure 2A:
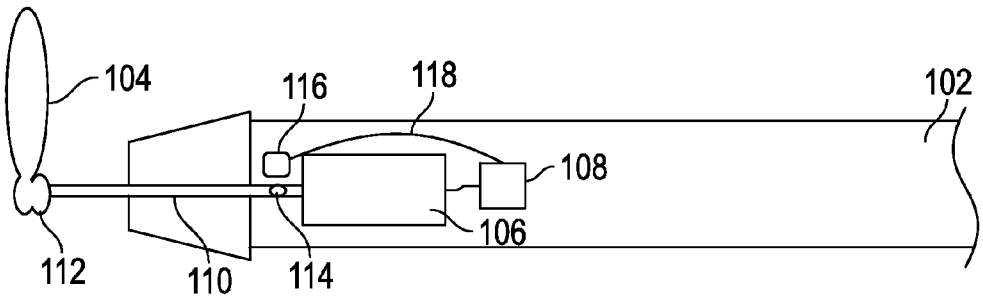
FIG. 2A is a perspective cross sectional view of one embodiment of an asymmetrical propeller system showing components of the system with the controlling mechanism disposed internal to the vehicle.
Figure 2B:
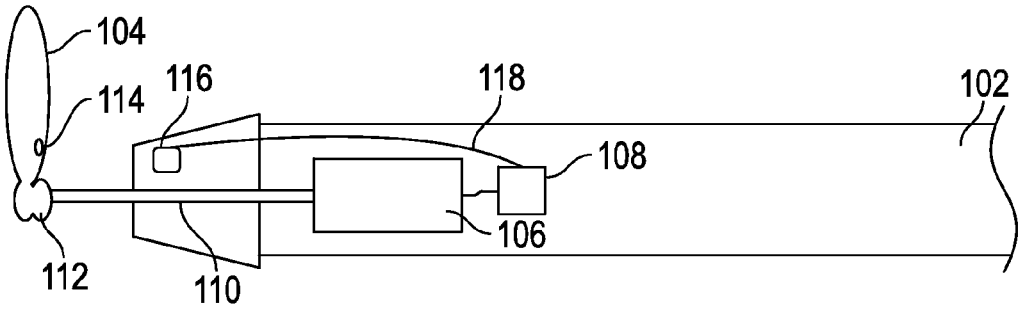
FIG. 2B is a perspective cross sectional view of one embodiment of an asymmetrical propeller system showing components of the system with the controlling mechanism disposed external to the vehicle.

Turning to FIGS. 2A and 2B, cross sectional views are provided showing components of one embodiment of an asymmetrical propeller system. For illustrative purposes, FIG. 2A depicts an embodiment of an asymmetrical propeller system wherein the controlling mechanism is disposed internal to the vehicle, whereas FIG. 2B depicts an embodiment of an asymmetrical propeller system wherein the controlling mechanism is disposed external to the vehicle. As shown in FIGS. 2A and 2B, the depicted embodiments of an asymmetrical propeller system comprises in general at least one blade 104 asymmetrically positioned around and attached to a central hub 112 which comprises the blade attachment means. The central hub 112 is in turn engaged with the motor connecting system comprised of a motor drive shaft 110 at a location substantially near one end of the connecting system. The other end of the motor drive shaft 110 (or other connecting means to engage the motor 106 with the propeller) is engaged with the motor 106 housed within motor compartment 102, such that motor 106 is capable of acting upon motor drive shaft 110 causing the at least one blade 104 to rotate in a controlled manner, creating the motive or thrusting force. Moreover, the depicted embodiment further comprises a controlling mechanism 118 comprising a controlling mechanism sensor 116, which is used, sometimes in conjunction with a blade localizer 114. The controlling mechanism sensor 116 and blade localizer 114 act as a feedback mechanism to determine where a designated propeller blade is in rotation, allowing for corrections and modifications as required for desired propulsion or movement. The controlling mechanism sensor 116 is in communication with a computer module 108 which is capable of reading and controlling the controlling mechanism sensor 116 and/or the blade localizer 114, the speed of the motor 106, and/or the propeller comprising the at least one blade 104.

As previously mentioned, one objective of the controlling mechanism 118 is to regulate the propeller rotational velocity. The controller most often regulates motor speed as a way to affect propeller velocity, typically by controlling power to the motor, although any suitable means to control rotational speed is within the scope of the invention. The controller may be used to produce propeller speeds which may be variable, constant, or a combination of variable velocity and periods of constant velocity during a revolution and/or between successive revolutions. Regulation of the controlling mechanism 118 may be predetermined by specific instructions hardwired or programmed into the computer module 108, manually or instantly controlled, or may automatically adjust based sensor feedback (e.g., water conditions).

The controlling mechanism 118 is in communication with the motor 106 through an electrical, optical, acoustic, or wireless connection or other suitable means to provide data communications and/or power to the computer module 108. Communications between the position sensor(s) (i.e., controlling mechanism sensor 116, blade localizer 114) and the computer module 108 may also be cabled or may communicate wirelessly through an electrical, optical, or acoustic means. Data provided by the sensor(s) to the computer module 108 may also be provided to the motor 106 to control hub or blade speed (to accelerate or decelerate) over a portion of the arc of the blade rotation.

This invention pertains to any propulsion system comprising propulsion generating surfaces (i.e., thrusting surfaces) such as blades or spoons, grooves, projections, slabs, or curved or flat plates which rotate around a central axis. For the purpose of this disclosure, all such propulsion generating features will be considered to be "blades" regardless of their shape or size. A key feature of the invention is that the overall thrusting force generated by one portion (e.g. thrusting surface) of the propeller is unequal to that from the other portion. This is accomplished by asymmetric distribution of thrust-generating surfaces or by asymmetric thrust production about the axis of the central hub 112.

As previously noted, a propeller is considered an asymmetric propeller if there is more force generated from a thrust surface on one side of the axis of rotation relative to the opposite side of the axis. Therefore, a single bladed propeller would by definition be considered asymmetric, but it should be noted that two three or more blades may also configured asymmetrically around a propeller hub. Even propellers featuring two or more diametrically opposed blades 104, as long as the blades 104 are not substantially identical in thrust force generation are considered to be asymmetric. Asymmetrical force from symmetrically disposed blades can be generated in any number of ways including but not limited to: differences in blade shape (e.g., width, length, thickness, contour, sweep angle and feathering, blade leading edge (i.e., edge of the blade that first cuts the water), blade design, blade trailing edge shape (i.e., blade edge from which water exits) design), blade surface area (e.g., size, thrust distribution), blade material properties (e.g., elasticity, compressive properties, density, frictional properties, smoothness, surface coating), and/or orientation (e.g., hub position, sweep angle, blade direction, pitch angle, rake (i.e., blade slant forward or back)) relative to the hub 112. In other embodiments, thrusting asymmetry is established by uneven blade positioning around the hub 112 or through the use of individual blades 104 with substantially different thrusting forces.

The blades 104 of the propeller may be constructed from a plurality of materials dependent upon the performance requirements. Such materials may comprise stainless steel, aluminum, plastics, titanium, composites (e.g., copper alloy, steel alloy, aluminum alloy, carbon fiber), a combination of materials, or other suitable materials known in the art. For corrosion resistance, the blades may be coated in a protective coating such as zinc, chrome plating, paint, epoxies, or similar means to withstand the aquatic environment.

The propeller may accommodate blades 104 positioned in various blade geometries as to best suit the thrust needs and maneuverability of the aquatic vehicle. Such geometries may include the blade sweep angle as defined as the angle of rotation of the longitudinal axis of the blade (i.e., the blade attachment point to the blade tip) rotated around a position ranging from its attachment point to the central hub 112 up to the blade tip. Modifying the blade sweep angle relative to the central hub 112 may translate into increased motor efficiency, thrust generation, and/or increased maneuverability. In some cases, the propeller utilizes a "back swept" shaped blade, while in other embodiments, a "forward swept" blade is used. Altering the sweep angle of the blade may allow for increased thrust by reducing amount of drag on the blade surface. However, it may be possible to use both a forward swept and back swept blade 104 on the same system, thereby causing asymmetry. In some embodiments, the blade 104 is rotated in either direction to a sweep angle of 1 to 15 degrees, 15 to 20 degrees, 20 to 25 degrees, 25 to 30 degrees, 30 to 45 degrees, but preferably at an angle between 1 to 30 degrees. In other embodiments, the blades 104 are rotated at sweep angles greater than 45 degrees up to 90 degrees. In other cases, the vehicle benefits from a propeller comprising blades 104 of a sweep angle of 0 degrees.

Feathering of the sweep angle along the longitudinal axis of the blade 104 may also contribute to the asymmetric propulsion characteristics of the inventive system. Some blade configurations may vary the sweep angle at multiple points throughout the length of the blade 104 (i.e., twisted from blade attachment point to blade tip). For example, the point of the blade attached at the central hub 112 may be of a sweep angle such as 0 degrees and progressively increases the sweep angle to 30 degrees or other desired angle up to the tip of the blade. Any suitable sweep angles and feathering of sweep angles along the blade 104 would be recognized by one of ordinary skill in the art.

Some propellers may utilize more than one blade 104 symmetrically disposed around a central hub 112 but achieve asymmetric propulsion through variance in blade sweep angle. For example, one blade 104 may swept (back or forward) at one specific sweep angle, and the subsequent blades 104 may be swept at one or more different angles overall contributing to unequal contributions of thrust. Additionally, it is possible for only a proportion of the symmetrically disposed blades 104 on the propeller to be rotated to one or more sweep angles thus producing an asymmetric amount of thrust during propeller rotation.

Furthermore, in some embodiments, the sweep angle of the blade 104 may be modified during propeller operation to obtain the highest efficiency in thrust output as determined by operation circumstances such as vehicle load, water conditions, acceleration requirements, fuel considerations, or other instances where thrust output requires modification. Altering the sweep angle of the blades 104 may allow the thrust output to be modified while allowing the speed of the motor 106 to remain the same. In such cases, the blade or blades 104 may be attached to the central hub 112 at an adjusting point that rotates to allow the blades 104 to rotate in accordance to the desired sweep angle. Changes to the sweep angle may be actuated by the controlling mechanism 118, through a remote signal, may automatically adjust according to the thrust and/or power levels of the motor 106 or speed of the vehicle, or any other suitable mode of signaling.

Additionally, a swept blade configuration may be advantageous in certain aquatic environments where marine plant life is abundant. Adding a sweep angle to one or more of the blades 104 may reduce the likelihood of biofouling and/or entanglement among marine plants. For example, sweeping the blade backwards may decrease the likelihood of fouling the blade on seaweed.

Although the present system is designed to be employed by embodiments using both single and multiple blades, single blade units have shown promise as they are less likely to become fouled by catching and becoming entangled or coated with material, debris, and organic matter when compared to a propeller having a plurality of blades.

In some single blade embodiments, additional balance is created to balance the force generated by the single blade. For example, a person having ordinary skill in the art would recognize that counter weights can be employed in various embodiments to counter the force. In some embodiments, weights are employed on or within the blade 104 at any point suitable to balance the generated thrust force. In other embodiments, weight is removed (e.g., shaved off, hollowed) along or within one or more areas of the blade 104. Additionally, a combination of adding and removing weight along specific regions of the blade 104 or any other suitable point on the propeller system may be appropriate as well. In some embodiments, counter weights of suitable mass are affixed on or near the hub in positions suitable to produce the necessary counterweight. Likewise, the controlling mechanism 118 or other computer systems 108 may be programmed to compensate for the asymmetrical forces put on the stem of the hub 112 and bearings used to attach the blades 104 to the central hub 112 and the central hub 112 to the drive shaft 110.

The motor driven propeller can comprise any motor 106 suitable for use in a marine thruster such as an electric motor, hydraulic motor, diesel motor, stern drive motor, AC motor or the like capable of providing the power necessary to generated the commanded thrust levels. In one or more embodiments, a brushless DC motor may be used. Moreover, in alternate, related embodiments, the motor may be a brushless DC that typically comprises a rotating ring of magnets. As previously discussed, the motor 106 is connected to hub 112 of the propeller by means of a drive shaft, a crank shaft, gearbox, direct attachment, or other suitable connecting means.

The inventive motor-driven propulsion system may be integrated with any suitable motor configuration as known in the art. In some embodiments, the inventive system is used with an inboard motor mounted inside an aquatic vehicle and the inventive propeller disposed on the outside of the vehicle. A connecting drive system passes through the hull of the vehicle to transfer motive force from the motor to the propeller. In other embodiments, an outboard motor configuration is employed wherein the motor and propeller are disposed on the outside of the vehicle with the motor 106 and additional electronics and/or gearing (e.g., controlling mechanism 118, computer 108, sensors, etc.) protected in a water-tight housing.

In many embodiments utilizing the inventive propulsion system, the controlling mechanism 118, more specifically the computer module 108, communicates signals to the motor 106 to control the motor 106 and propeller velocity with respect to the radial position of the propeller's blade 104. Such signals may be derived from feedback information acquired by the sensors (i.e., blade localizer 114 and controlling mechanism sensor 116) or may be received from another suitable source such as a remote signal. During desired portions of the rotation arc of higher velocity, the motor 106 is signaled to change power to the propeller and change thrust force (e.g., to change velocity). Thus, the signals from the controlling mechanism 118 regulate power to the motor 106 according to thrust requirements over one or more portions of the axis of rotation (e.g., to change directions of the vehicle).

In various embodiments, the asymmetrical propulsion system utilizes a feedback mechanism capable of determining the precise orientation of the propeller (and/or the hub 112, blades 104, drive shaft or rotor 110) during a revolution. Specifically, a blade localizing means (i.e., an index point), referred to as the blade localizer 114, is affixed to any rotating portion of the motor 106, the drive train 110 (or connecting means), or propeller. A sensor (i.e., controlling mechanism sensor 116) capable of precisely detecting and determining the exact location of the blade localizing means at at least one point in its rotational path is fixed to a convenient location to determine the position of the blade localizing means (i.e., blade localizer 114) for each revolution. In such embodiments, the controlling mechanism sensor 116 is connected to the computer module 108 so that the positional information it provides may be used to guide velocity and/or power regulation of the motor 106 during individual revolutions of the propeller.

Provided the sensors are capable of relaying data to the computer 108 in controlling mechanism 118 about the precise radial location of the targeted blade 104, typical locations upon which the sensors (including the controlling mechanism sensor 116 and the blade localizer 114) are located include the drive shaft 110, the blade 104, the central hub 112, or the motor housing 102. In the embodiment depicted in FIG. 2A, the feedback mechanism (i.e., controlling mechanism 118) comprises, in part, a controlling mechanism sensor 116 which is an optical sensor which visually detects the location of blade localizer 114 which is an optical indicator (i.e., a color, pattern, physical marking, or other aspect capable of being sensed by the optical sensor) on blade 104, allowing the system to determine the location of the blade 104 during rotation.

Alternative feedback (sensor/detector) mechanisms include but not limited to, magnetic sensors (e.g., inductive proximity sensors), electromagnetic sensors, electrical contact sensors, hall sensors, visual counting sensors, light detectors (e.g., infrared detectors, inductive light sensors to detect a light beam break) and the like. In some embodiments, the feedback mechanism comprises two sensors, one coupled to the central hub 112 and the second sensor coupled to the hub 112 on the side opposite to the first sensor to balance the weight.

Furthermore, the type of sensors used may dictate the location of the sensors. However, regardless of the sensing mechanism or components used, the components are meant to serve as a localizing means to determine location of the blade 104 which is relayed to the controlling mechanism 118 so that the controlling mechanism 118, specifically the computer module 108, can signal the motor 106 to modify the blade's actions and velocity as required. For example, the computer 108 in controlling mechanism 118 can make modifications to modify how much of the arc of the blade 104 needs to be accelerating or accelerated (or decelerated), the acceleration can be varied through radial position, or the system can trigger pulsatile acceleration, each based on the function desired.

Likewise, it should be noted that the asymmetrical propulsion system can be located in various positions on a nautical craft, and may be used in conjunction with numerous types of nautical crafts regardless of whether or not the craft further employs a rudder. Although the typical embodiment would employ the asymmetrical propulsion system in the rear of the nautical craft, it is possible to locate one or more of the system on other areas of the craft besides the craft, such as the front, side, top, or bottom area of the vehicle. In other embodiments, two or more propulsion systems are disposed on the nautical craft. Moreover, embodiments of crafts employing the asymmetrical propulsion system are envisioned wherein a system is located on both the front and back of the craft allowing for greater maneuverability.

Propeller Rotational Velocity and Steering

For ordinary forward propulsion of an aquatic vehicle, the propeller is operated at a constant rotational velocity by the motor 106. In order to change horizontal or vertical direction, the instantaneous rotational velocity of the propeller may be altered as a function of angular position such that the propeller blade or blades 104 travel faster on one side of the rotation than on the other. When such revolution velocity variation is reproducibly applied on many successive revolutions (defined herein as differential velocity), because lift is proportional to the square of the velocity, the forces are greater on one side of the axis than the other, and a turning moment is induced.

Creation of a differential velocity to produce asymmetric thrust may be accomplished by any mechanical or electrical controlling means, herein referred to as the controlling mechanism 118, known to those skilled in the art capable of reproducibly causing within a revolution velocity changes across sequential revolutions. For instance, mechanical-based differential velocity control system could consist of adjacent gears or belt-connected cams mounted off-center such that constant rotational velocity into one is converted into non-constant rotational velocity in the other. Electrical-based controlling means or systems on the other hand, may involve varying the voltage to an electric motor in a controlled fashion such that the torque on one half of the rotation is greater than the other. Such electronic control systems may be prepared in either analog or digital format and may or may not use specific software to control them.

In some embodiments, at least one sensor is used to monitor the angular position of the propeller as it moves throughout its rotation. An electronic controller (i.e., the controlling mechanism 118) uses feedback from the sensors (i.e., blade localizer 114, controlling mechanism sensor 116) to script the instructions to vary voltage to the motor and establish the required differential velocity. One example of this would be the modulation of the AC signal to a multi-poled DC brushless motor such that the voltage and therefore the torque is increased on one half of the rotation relative to the other. In this way, the portion of the asymmetric propeller assembly with the maximum thrusting force (MTF) would briefly accelerate during one portion of its rotation and thus induce a turning moment towards the opposite direction.

The production of differential velocity on the asymmetric propellers of the invention may be considered to have at least five aspects: One is the angular position around which the MTF must be centered in order to effect a turn in the desired direction, herein referred to as the point A. The second is the amount of time (or arc length) during a single revolution for which the propeller velocity is maintained at its higher value. Two other aspects are the actual velocities (low=$V_l$ and high=$V_h$) used to produce the differential velocity relationship. The fifth aspect is the relative difference between the $V_h$ and $V_l$.

As depicted in Panel 2 of FIG. 1, to turn a vessel in any direction B, relative to the orientation of the propeller, the velocity of the propeller will generally be made to be high when the MTF of the propeller is present at point A on the rotational arc, directly opposite from the desired turning direction B, and will be reduced at some point thereafter. The length of the arc in a single revolution of the propeller, for which the MTF is centered around point A, and for which the increased velocity is applied in order to create a turning moment may be any appropriate portion of a revolution provided it is applied in a substantially reproducible fashion over successive revolutions until the desired directional change has been accomplished.

The length of the arc (or length of time) for which the MTF is maintained at $V_h$ may be expressed relative to one propeller revolution as the proportion, 360−L/360, where L is the length of the arc in degrees centered around A for which MTF maintained at a $V_h$. Thus, in order to create a turning moment towards the direction B, any value for L between but not including 0 and 1 may be useful. In preferred embodiments, values for L are 0.1, 0.25, 0.33, 0.5, 0.75, and 0.85.

In some embodiments, $V_h$ will be applied for a duration of 1 to 5 degrees of the arc; in others, it will be applied for 10 degrees, 15, 20, 25, or 30 degrees of the arc. In other embodiments, the increased velocity will be applied for 30 up to 180 degrees, 180 up to 270 degrees, 270 up to 330 degrees, and up to 359 degrees.

The inventive asymmetric propellers may employ any suitable angular velocities to establish the differential velocity required to effect turning. However, 1-10,000 rpms, the standard angular velocities in typical marine and submarine propellers, are suitable for the inventive propellers. Within these ranges, in many of the inventive embodiments, ratios for high velocity $V_h$ to low velocity $V_l$ within a single revolution will range from 1.1, to 1.5, to 2.0, to 2.5, or in some instances greater than or equal to 3, 5, 10, or even 20 fold. Some embodiments feature velocity differentials greater than or equal to 30 to 100 fold.

The $V_h$ need not be applied as a constant velocity, but may be applied in ramped, pulsed, or other forms. In such cases, the vehicle will turn in the direction opposite the point around which the net higher thrust is centered.

Example of the Single Blade Propeller for Propulsion and Maneuvering

Figure 3:
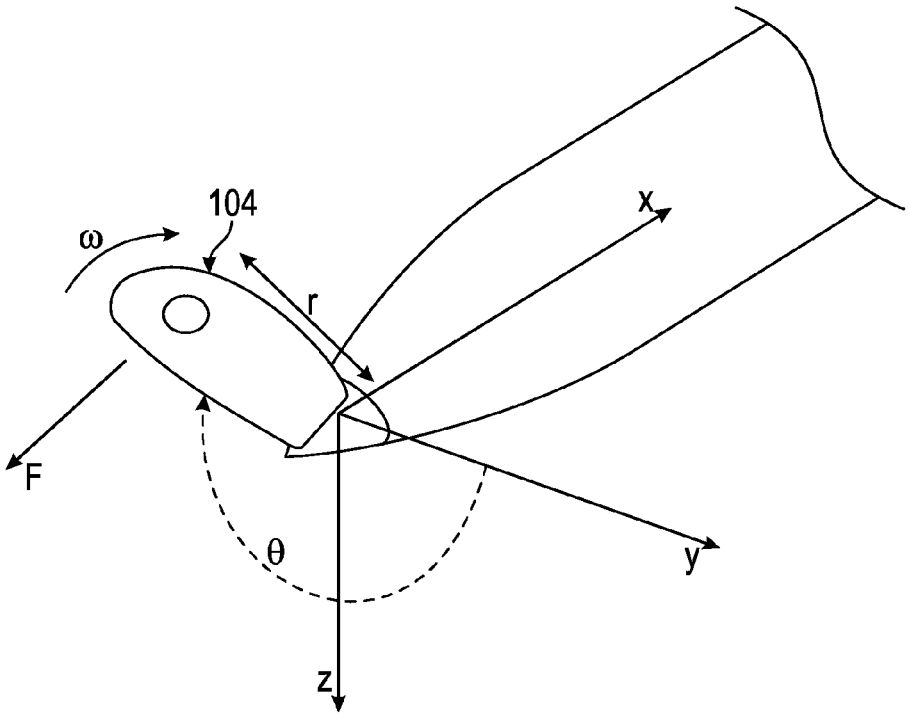
FIG. 3 is a diagram of a single blade propulsion system showing potential angular movements of the blade.

FIG. 3 shows the coordinate system and variables for an embodiment that is a single blade propeller system. The x-axis is oriented forward, y-axis starboard, and z-axis down. The position of the single blade 104, shown in solid black, is measured by angle θ from the positive y-axis. The blade moves with angular velocity ω. We make the simplifying assumption that the thrust force F of the propeller acts at a single point, shown in grey, a distance r from the axis of rotation.

The nominal angular velocity $\omega_o$ will be modified by a sinusoid of amplitude $\omega_a$.

$$\omega(t) = \omega_o + \omega_a \cos\left(\frac{2\pi}{T}t - \phi\right)$$

such that $0 \geq \omega_a \geq \omega_o$. Integrating this over one period T, we find that $T=2\pi/\omega_o$. In practice, the phase angle φ can be changed to control the angle at which the maximum velocity occurs, but here we set it to 0 for simplicity.

The angular position θ(t) can be determined by integrating the angular velocity.

$$\theta(t) = \int_0^t \omega_o + \omega_a \cos(\omega_o t)dt = \omega_o t + \frac{\omega_a}{\omega_o}\sin(\omega_o t)$$

The horizontal turning moment arm y(t) is simply r cos(θ(t)).

The turning moment induced by a single bladed propeller is the instantaneous force F(t) times the moment arm y(t) integrated over the time period T of one full revolution. Normalizing this moment by the total force over one revolution yields the equivalent moment arm ỹ.

$$\tilde{y} = \frac{\frac{1}{T}\int_0^T F(t)\cdot y(t)dt}{\frac{1}{T}\int_0^T F(t)dt}$$

The thrust force is proportional to the square of the velocity $F \propto (\omega r)^2$. Defining $$\zeta = \frac{\omega_a}{\omega_o}$$

(i.e. me velocity adjustment proportional to the nominal velocity), converting time to radians $\tau=\omega_o t$, and normalizing by the radius $$\hat{y} = \frac{\tilde{y}}{r}$$

we arrive at a simplified dimensionless representation of the moment arm as a function of ζ.

$$\hat{y}(\zeta) = \frac{\int_0^{2\pi}(1+\zeta\cos\tau)^2\cdot\cos(\tau+\zeta\sin\tau)d\tau}{\int_0^{2\pi}(1+\zeta\cos\tau)^2 d\tau}$$

Figure 4A:
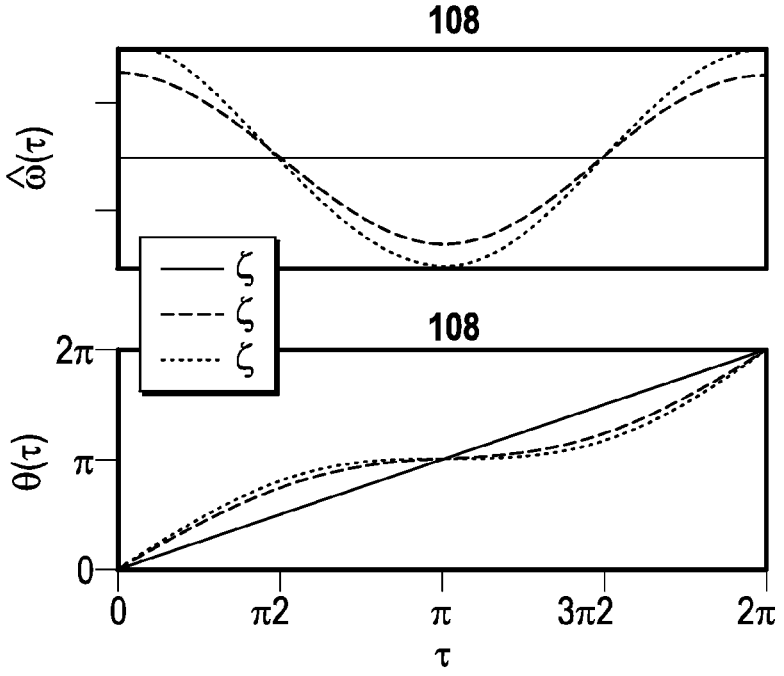
FIGS. 4A and 4B depict a series of tables showing, in the upper left, a normalized angular velocity as a function of normalized time; in the lower left, angular position as a function of normalized time, and on the right, moment arm as a function of proportional adjusted velocity.
Figure 4B:
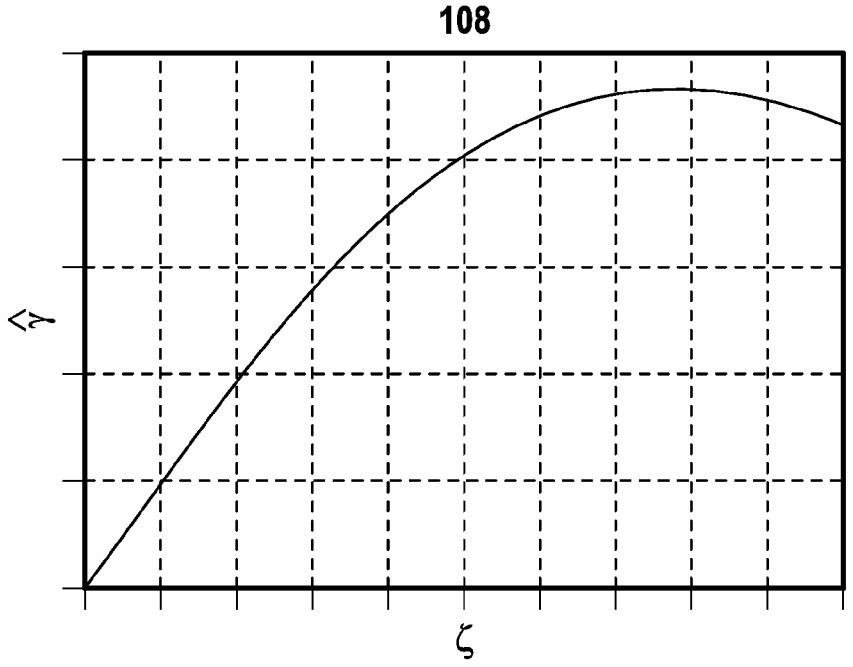

FIG. 4 at left shows the angular velocity and position as a function of time τ for various values of ζ. At right the normalized moment arm ŷ is plotted as a function of ζ. Intuitively, ŷ represents the fraction of the radius r along the y-axis where the integrated force of a single rotation appears to act. For instance, with no velocity adjustment, $\zeta=0$ and there will be zero moment with the force acting at the origin. At the maxima around $\zeta=0.78$, the effect will be equivalent to the same force acting at about 23% the length of r from the origin.

While this moment arm is small, it could be sufficient to correct a vehicle's heading drift over time and to maintain a constant depth. More complex control functions $\omega(t)$ can be developed to further increase the turning moment arm $\hat{y}$ for tighter maneuvering. Increasing the propeller radius will increase the turning moment as well, as may different propeller shapes.

Fail-Safe System

Although the embodiments previously referred to purport to demonstrate asymmetrical propulsion units as stand-alone systems, it should be stressed that the applications of the present invention are not so limited. For example, it is also contemplated that the present invention can be applied as a fail-safe mechanism. In the unfortunate event of an otherwise symmetrical propeller breaking a propeller blade, as well as losing control of any additional control surfaces such as the fins, this approach could be used to maneuver the vehicle. More practically, in an embodiment where several propeller blades are asymmetrically distributed around the shaft or are different sizes, breaking one blade would still allow the vehicle to continue its mission with control over both forward thrust and lateral maneuverability. The system would have to employ steps which would 1) realize that propeller blades have been lost (or some other asymmetry has occurred) and 2) calibrate the control such that the commands sent to the propeller take into account the missing blades. In such an embodiment, the system would comprise an asymmetry sensor for use with a symmetrical blade propulsion systems which sense if any asymmetry would occur in the propeller. For example, in the event one or more of the blades of a symmetrical propeller system were damaged, the balance of the blades and the subsequent thrust generated by them would be asymmetrical.

The asymmetry sensor may be designed by any suitable method to determine when a previously symmetrical propeller becomes an asymmetrical propeller. In some embodiments, the asymmetry sensor may also be the blade localizer 114 and/or controlling mechanism sensor 116. In other cases, the asymmetry sensor may work in combination with the controlling mechanism 118. Other such asymmetry sensors may include magnetic sensors, electromagnetic sensors, hall sensors, visual counting sensors, stress sensors, sonic sensors, tilt sensor, image sensor, gyroscopic sensor, accelerometer, or other suitable means. Some embodiments employ an optical transceiver or receiver to detect light waves (e.g., ultraviolet, visible, infrared, microwave, radio) as a means of communication. In other embodiments, the asymmetry sensor is a vibration sensor capable of detecting changes in vibrational status, position, accelerated movement, propeller impact, or any suitable mechanical shock or change. In other embodiments, a flow sensor is connected to the propeller, central hub 112, or other proper position to determine the amount of water displaced by the thrust generated by the propeller; in such cases where the thrust force is decreased without regulation by the controlling mechanism 118, the fail-safe mechanism may be automatically or manually engaged.

A person having ordinary skill in the art would recognize that in light of the present disclosure, a system under the present invention can be designed to work in concert with symmetrical propulsion units in the event that the unit becomes asymmetrical. Feedback mechanisms, i.e., the asymmetry sensors, similar to as those already discussed could be installed into symmetrical propeller systems which would either lie dormant during normal (symmetrical) operation or otherwise monitor the normal operation either continuously or periodically to determine if asymmetry occurs. If asymmetry occurs, the fail-safe system can be triggered, either manually or self-triggering upon alert by the feedback mechanisms to the asymmetry, causing the system to operate as discussed previously to generate propulsion as an asymmetrical propulsion unit.

We claim:

1. A marine propulsion system comprising:

a. a motor;

b. a motor driven propeller having a central hub with an axis of rotation with at least one thrusting surface which revolves around the axis of rotation; and, c. a controlling mechanism in communication with the motor;

wherein the controlling mechanism is capable of regulating the motor speed to produce differential velocity within a single revolution of the propeller across sequential rotations and generate a turning moment.

2. The propulsion system of claim 1, wherein said at least one thrusting surface is disposed asymmetrically around the central hub.

3. The propulsion system of claim 1, wherein at least two thrusting surfaces are disposed asymmetrically around the central hub.

4. The propulsion system of claim 1, wherein the propeller is an asymmetric propeller, and the asymmetric thrust is generated from the rotation of the propeller.

5. The propulsion system of claim 1, wherein the asymmetric thrust arises from means selected from a group consisting of asymmetric positioning of one or more thrusting surfaces around the central hub, a variance in blade shape, a variance in blade orientation, a variance in sweep angle, an uneven number of thrusting surfaces, and a combination thereof.

6. The propulsion system of claim 1, wherein each said at least one thrusting surface comprises a blade selected from the group consisting of spoons, grooves, projections, slabs, curved plates, and flat plates.

7. The propulsion system of claim 6, further comprising at least one thrusting surface with a blade sweep angle less than 90 degrees.

8. The propulsion system of claim 7, further comprising at least one thrusting surface with a blade sweep angle that is between 1 and 30 degrees.

9. The propulsion system of claim 1, wherein the controlling mechanism is in communication with a sensor which is capable of determining the location of at least one thrusting surface in rotation.

10. The propulsion system of claim 1, wherein the controlling mechanism comprises a blade localizing means to localize the position of at least one thrusting surface.

11. The propulsion system of claim 10, wherein the controlling mechanism further comprises a means to determine the radial velocity required at said position, and a means to vary the rotational velocity of the motor within a single revolution and between successive revolutions.

12. The propulsion system of claim 1, wherein the propulsion system is disposed on an aquatic vehicle.

13. The propulsion system of claim 12, wherein one or more asymmetric propulsion systems is disposed on the aquatic vehicle in a location selected the group consisting of from the back end of the vehicle, the front end of the vehicle, a side portion of the vehicle, the top of the vehicle, the bottom of the vehicle, and one or more combinations thereof.

14. A propulsion system comprising:

a. A motor;

b. A motor driven propeller capable of rotation about an axis comprising one or more thrusting surfaces disposed asymmetrically around the axis; and, c. A controlling mechanism in communication with said motor;

wherein said controlling mechanism is capable of producing a reproducible pattern of differential velocity within a single revolution of the propeller across sequential rotations to generate a desired thrusting force.

15. The propulsion system of claim 14, wherein the controlling mechanism is capable of producing a pattern of varying rotational velocity of the propeller within a single revolution and between successive revolutions.

16. The propulsion system of claim 14, further comprising a blade localizing means which is capable of determining the location of at least a portion of the propeller during a rotation, wherein the blade localizing means is in communication with the controlling mechanism.

17. The propulsion system of claim 14, wherein each thrusting surface comprises a blade selected from the group consisting of spoons, grooves, projections, slabs, curved plates or flat plates.

18. The propulsion system of claim 14, further comprising at least one thrusting surface with a blade sweep angle less than 90 degrees.

19. The propulsion system of claim 18, further comprising at least one thrusting surface with a blade sweep angle between 1 and 30 degrees.

20. The propulsion system of claim 14, wherein the propulsion system is disposed on an aquatic vehicle.

21. The propulsion system of claim 20, wherein one or more asymmetric propulsion systems is disposed on the aquatic vehicle in a location selected the group consisting of from the back end of the vehicle, the front end of the vehicle, a side portion of the vehicle, the top of the vehicle, the bottom of the vehicle, and one or more combinations thereof.

22. A method for maneuvering the direction of an aquatic vehicle comprising:

a. providing an asymmetric propulsion system with one or more thrusting surfaces capable of asymmetric thrust by reproducibly causing within a single revolution velocity differential and between successive revolutions repeating said velocity differential; and b. engaging a controlling mechanism of said asymmetrical propulsion system, thereby generating asymmetric thrust.

23. The method of claim 22, wherein the asymmetric thrust is generated at least in part within a single revolution and between successive revolutions.

24. The method of claim 23, wherein the asymmetrical thrust is used to turn said aquatic vehicle.

25. The method of claim 22, wherein the asymmetric thrust is generated by the regulating the motor speed to vary rotational velocity of the propeller one or more times per revolution and over successive revolutions.

26. The method of claim 22, wherein the asymmetric thrust is generated by variance in blade geometry of one or more thrusting surfaces disposed on the central hub.

* * * * *